US010927480B2

(12) United States Patent
Beran et al.

(10) Patent No.: US 10,927,480 B2
(45) Date of Patent: Feb. 23, 2021

(54) LINEAR FIBROUS FORMATION WITH A COATING OF POLYMERIC NANOFIBERS ENVELOPING A SUPPORTING LINEAR FORMATION CONSTITUTING A CORE, A METHOD AND A DEVICE FOR PRODUCING IT

(71) Applicant: Technicka Univerzita v Liberci, Liberec (CZ)

(72) Inventors: Jaroslav Beran, Liberec (CZ); Jan Valtera, Liberec (CZ); Martin Bilek, Liberec (CZ); Ondrej Batka, Liberec (CZ); Josef Skrivanek, Frydlant v Cechach (CZ); Petr Zabka, Liberec (CZ); Jiri Komarek, Jablonec nad Nisou (CZ); David Lukas, Liberec (CZ); Pavel Pokorny, Frydlant v Cechach (CZ); Eva Kuzelova-Kostakova, Turnov (CZ); Petr Mikes, Mnisek u Liberec (CZ); Jiri Chvojka, Liberec (CZ); Tomas Kalous, Liberec (CZ); Filip Sanetrnik, Liberec (CZ)

(73) Assignee: TECHNICKA UNIVERZITA V LIBERCI

( * ) Notice: Subject to any disclaimer, the term of this patent is extended or adjusted under 35 U.S.C. 154(b) by 450 days.

(21) Appl. No.: 15/579,640

(22) PCT Filed: Jun. 1, 2016

(86) PCT No.: PCT/CZ2016/050017
§ 371 (c)(1),
(2) Date: Dec. 5, 2017

(87) PCT Pub. No.: WO2016/192697
PCT Pub. Date: Dec. 8, 2016

(65) Prior Publication Data

US 2018/0355521 A1 Dec. 13, 2018

(30) Foreign Application Priority Data

Jun. 5, 2015 (CZ) ..... PV 2015-382

(51) Int. Cl.
*D01H 4/28* (2006.01)
*D02G 3/36* (2006.01)
(Continued)

(52) U.S. Cl.
CPC ..... *D01H 4/28* (2013.01); *D01D 5/0084* (2013.01); *D01F 1/10* (2013.01); *D01F 6/46* (2013.01);
(Continued)

(58) Field of Classification Search
None
See application file for complete search history.

(56) References Cited

U.S. PATENT DOCUMENTS 8,613,227 B2 12/2013 Bitto et al.
10,041,189 B2 8/2018 Kocis et al.
(Continued)

FOREIGN PATENT DOCUMENTS

CN 104032423 A 9/2014
CN 104195700 A 12/2014
(Continued)

OTHER PUBLICATIONS

Machine translation of JP2011214168 (Year: 2011).*
(Continued)

*Primary Examiner* — Shawn Mckinnon
(74) *Attorney, Agent, or Firm* — Ostrolenk Faber LLP

(57) ABSTRACT

A method, system, and resulting linear fibrous formation are provided wherein a supporting linear formation defines a core that is transported through a spinning chamber. A coating of polymeric nanofibers enveloping the supporting
(Continued)

linear formation in the spinning chamber. The coating of polymeric nanofibers comprises a flat stripe wound around the core into a helical form, the flat stripe created from a hollow electrically neutral nanofibrous plume generated in a spinning space above a spinning electrode during spinning by AC electric voltage in the spinning chamber.

6 Claims, 5 Drawing Sheets

(51) Int. Cl.

| | |
|---|---|
| ***D01H 7/92*** | (2006.01) |
| ***D02G 3/40*** | (2006.01) |
| ***D02G 3/02*** | (2006.01) |
| ***D01D 5/00*** | (2006.01) |
| ***D01F 1/10*** | (2006.01) |
| ***D01F 6/46*** | (2006.01) |
| *D01F 6/30* | (2006.01) |

(52) U.S. Cl.

CPC ..... *D01H 7/92* (2013.01); *D02G 3/02* (2013.01); *D02G 3/36* (2013.01); *D02G 3/402* (2013.01); *D01F 6/30* (2013.01); *D10B 2321/042* (2013.01); *D10B 2321/06* (2013.01); *D10B 2321/10* (2013.01); *D10B 2331/04* (2013.01); *D10B 2331/10* (2013.01); *D10B 2401/04* (2013.01)

(56) References Cited

U.S. PATENT DOCUMENTS

| | | | |
|---|---|---|---|
| 2012/0295109 | A1 | 11/2012 | Jirsak et al. |
| 2015/0315724 | A1 | 11/2015 | Kocis et al. |

FOREIGN PATENT DOCUMENTS

| | | | | |
|---|---|---|---|---|
| CN | 104345047 | A | | 2/2015 |
| CZ | 2007-179 | A3 | | 9/2008 |
| CZ | 20 090 148 | A3 | | 9/2010 |
| CZ | 305039 | B | | 6/2011 |
| CZ | 305133 | B | | 6/2011 |
| CZ | 304137 | B6 | | 11/2013 |
| JP | 2009-144290 | A | | 7/2009 |
| JP | 4922144 | B | | 7/2009 |
| JP | 2009-280923 | A | | 12/2009 |
| JP | 4922237 | B | | 12/2009 |
| JP | 2010-084306 | A | | 4/2010 |
| JP | 2011214168 | A | | 10/2011 |
| JP | 2014-163003 | A | | 9/2014 |
| JP | 2016-503838 | A | | 2/2016 |
| WO | WO 2008/106904 | A1 | | 9/2008 |
| WO | WO2014079400 | | * | 5/2014 |
| WO | WO 2014/094694 | A1 | | 6/2014 |

OTHER PUBLICATIONS

Article 1—M. B. Bazbouz and G. K. Stylios, "A New Mechanism for the Electrospinning of NanoYarns", Journal of Applied Polymer Science, (Oct. 4, 2011), vol. 124, No. 1, doi:10.1002/app.31930, ISSN 0021-8995, pp. 195-201, XP055015565 [X] 1 * the whole document *.

Article 2—C. I. Su, T. C. Lai, C. H. Lu, Y. S. Liu, and S. P. Wu, "Yarn Formation of Nanofibers Prepared Using Electrospinning", Fibers and Polymers, (Apr. 2013), vol. 14, No. 4, doi:10/1007/s12221-013-0542-4, ISSN 1229-9197, pp. 542-549, XP002764516 [X] 1 * p. 543; figure 2 * * p. 546 *.

Article 3—S. A. H. Ravandi, R. H. Sanatgar, and F. Dabirian, "Wicking Phenomenon in Nanofiber-Coated Filament Yarns", Journal of Engineered Fibers and Fabrics, (Mar. 2013), vol. 8, No. 3, pp. 10-18, XP002764517 [X] 1 * p. 12-p. 14; figures 3-4 *.

Article 4—Jirsak O et al, "Nano fiber-covered yarns", Chemical Fibers International, IBP Press, Frankfurt Am Main, DE, (Jun. 1, 2011), vol. 61, No. 2, ISSN 0340-3343, pp. 84-86, XP001562996 [A] 1 1,7,10-12 * p. 85; figures 2-4 *.

PCT Search Report, dated Dec. 15, 2016.

Czech Republic Search Report, dated Mar. 11, 2016.

PCT International Preliminary Report on Patentability, dated Dec. 5, 2017.

PCT Written Opinion, dated Dec. 15, 2016.

* cited by examiner

LINEAR FIBROUS FORMATION WITH A COATING OF POLYMERIC NANOFIBERS ENVELOPING A SUPPORTING LINEAR FORMATION CONSTITUTING A CORE, A METHOD AND A DEVICE FOR PRODUCING IT

TECHNICAL FIELD

The invention relates to a linear fibrous formation with a coating of polymeric nanofibers enveloping a supporting linear formation constituting a core.

The invention also relates to a method for the production of a linear fibrous formation with a coating of polymeric nanofibers enveloping a supporting linear formation constituting a core in a spinning chamber, in which is arranged a spinning electrode powered by alternating high voltage.

In addition, the invention relates to a device for producing a linear fibrous formation, comprising a device for feeding the supporting linear formation to a spinning chamber, in which is arranged a spinning electrode connected to a source of alternating electric voltage to create a nanofibrous plume towards the path of the linear supporting formation, and a draw-off mechanism for withdrawing the resulting linear fibrous formation composed of a supporting linear formation with a coating of polymeric nanofibers from the spinning chamber.

BACKGROUND

So far, known linear fibrous formations containing a core composed of a supporting linear textile fibrous formation and a coating of nanofibers formed on the core are produced by the technology of electrostatic spinning, that is, due to the spinning effect of the direct current voltage generated as a result of the difference between the potentials of two electrodes.

CZ PV 2007-179 discloses a linear fibrous formation containing polymeric nanofibers that form a coating on the surface of a core composed of a supporting linear fibrous formation, whereby at least some nanofibers are caught among the fibers of the surface section of this core. Nanofibers are produced through electrostatic spinning (i.e. using high voltage DC sources), whereby the supporting linear formation is guided through the spinning space between a spinning electrode and a collecting electrode and false twist is imparted to it outside the spinning space. Therefore, the supporting linear formation in the spinning space rotates around its axis and on its surface are deposited individual nanofibers, being carried through the spinning space to the collecting electrode. Not all the nanofibers are caught on the supporting linear formation, but some of them fly over as far as the collecting electrode on which they are caught. This problem could not be eliminated even by an embodiment in which the collecting electrode was composed of a conductive supporting linear formation. Also in this embodiment, a large part of the nanofibers will pass the linear supporting formation and are caught on the walls of the spinning space.

Although the nanofibers are caught among the fibers of the surface section of the core, during the process of unwinding the nanofibers, the nanofibrous coating is pulled up from the core due to the forces acting between the surfaces of adjacent fibers in a package, these forces being greater than the cohesive force between the coating of nanofibers and the core.

The above-mentioned problems have been partly solved by CZ PV 2009-797, in which the nanofibers are fixed to the core by wrapping at least one cover thread around them. The wrapping with the cover thread ensures, for the majority of possible applications, sufficiently firm and resistant depositing of nanofibers on the core and at the same time enables to make full use of the unique properties of nanofibers, since it does not inhibit access to them. The fibrous formation itself is produced by multiple passage of the supporting linear formation through the spinning space, in which the supporting linear formation outside the spinning space is returned through a portion of the circumference of at least one cylinder, approaching it obliquely, so that when being returned, the supporting linear formation turns to the spinning electrode with its opposite side. In this embodiment, false twist is not applied, which means that when passing through the spinning space, the supporting linear formation does not rotate around its axis, and so the nanofibers are deposited during each passage at that side of the supporting linear formation that faces the spinning electrode. Given the multiple passage of the supporting linear formation through the spinning space, a greater amount of nanofibers are deposited on it than is the case in the preceding solution, although some of the nanofibers fly over as far as to the collecting electrode. Nanofibers are deposited on the surface of the supporting linear formation randomly as individual nanofibers forming layers and their adhesion to the core surface is small. Fixing of the nanofibers on the surface of the supporting linear formation is obtained by subsequent wrapping at least one cover thread around them.

U.S. Pat. No. 8,163,227 describes a device which is capable of producing a high-strength and uniform yarn that is partly made of nanofibers. Nanofibers are produced by the method of electrostatic spinning with high productivity and at low cost. The device according to this invention utilizes deposition of nanofibers spun from a nozzle spinning electrode, nanofibers being produced by it almost uniformly. Nanofibers are attracted to the thread passing through the center of a circular spinning electrode like to a collector, since this thread is electrically charged so as to attract nanofibers. This method is used for the formation of fibers by the method of the so-called DC electrostatic spinning. Voltage AC sources are used here in some variants of embodiments on the collector in order to create the so-called "rotating electrical field", which aims to promote creating a helical structure of the nanofibers on the yarn core. It is highly unlikely that the device according to the above-mentioned method will be capable of long-term production of nanofibrous core yarn for the following reasons:

(1) The method requires a change of flight direction of the nanofibers from horizontal to vertical. This cannot be achieved by nanofibers following the field lines, as is indicated in the drawings as well as in the text of the patent. It is caused by the fact that nanofibers after their formation strongly whip in the spinning space and therefore they considerably deviate from the direction of the field lines. Nanofibers are more likely to be deposited onto the collectors rather than on the offered yarn core.

(2) It is unlikely that the nanofibers moving in the spinning space at a speed of 3-10 m/s will be in their path significantly influenced by the rotary movement of the spinning electrode or the collector at lower circumferential speeds.

(3) However, high circumferential speeds of the spinning electrode or collector would result in strong centrifugal forces acting also on Taylor cones at the outlets of the capillaries of the spinning electrode. Thus, the polymeric solution would not be uncontrollably radially sprayed.

Even if such yarn was produced, it would have similar drawbacks as the above-mentioned linear fibrous formation according to CZ PV 2007-179.

A goal of the invention is to propose a linear fibrous formation containing a core of polymeric nanofibers, wherein firm connection of the core to the nanofibrous coating would be ensured without the necessity of wrapping a cover thread around it and, furthermore, mutual inertness of the surfaces of such linear fibrous formations would be guaranteed during the process of unwinding from a package on a bobbin, where it was previously deposited in a plurality of windings next to each other and a plurality of layers of these windings on top of each other. In addition, the aim of the invention is to propose a method for the production of such a formation and provide a device for producing it.

PRINCIPLE OF THE INVENTION

Additional objects and advantages of the invention will be set forth in part in the following description, or may be obvious from the description, or may be learned through practice of the invention.

The goals of the invention have been achieved by providing a linear fibrous formation according to the invention, whose principle consists in that a coating of polymeric nanofibers is composed of a flat stripe having an organized nanofibrous structure, the stripe being created from a nanofibrous plume that is generated above a spinning electrode during spinning using alternating high electric voltage and is wound around the core into a helical form. The hollow plume of nanofibers, generated during AC electrospinning, represents already prior to being folded into a flat formation, which is wound around the core into a helical form, represents an electrically neutral formation consisting of polymeric nanofibers arranged in an irregular grid structure. Even after being folded into a flat formation and after being wound around the core into a helix-shaped stripe, the plume of nanofibers is electrically neutral due to its electrical neutrality and the surface of the created linear formation is neutral also towards all the adjacent windings in the package on the bobbin. As a result, the resulting linear fibrous formation can be smoothly unwound from the package on the bobbin and processed by subsequent textile technologies.

The principle of the method for producing a linear fibrous formation according to the invention consists in that the plume of nanofibers generated on the spinning electrode powered by AC voltage in the spinning space changes into a flat stripe with an organized structure of nanofibers, which is guided to the circumference of the supporting linear formation rotating in the spinning space around its axis and/or in the form of a balloon with at least one antinode loop, whereby the stripe formed from the nanofibrous plume winds around the supporting linear formation into a helical form.

The advantages of the method for production of core nanoyarn consist in formation of a relatively strong/thick nanofibrous wind at a relatively high production speed of core yarn around 60 m/min. Moreover, nanofibers fly out of the winding minimally.

The principle of the device for the production of a linear fibrous formation according to the invention consists in that, in the path of the supporting linear formation, is arranged a twisting device that is capable of forming a balloon or at least false twist on the supporting linear formation in the spinning chamber, whereby due to ballooning and/or rotation of the supporting linear formation the nanofibrous plume in the form of a flat stripe with an organized structure of nanofibers winds around the supporting linear formation.

Behind the spinning chamber in the path of the supporting linear formation is arranged a drying and fixing device for drying and fixing the stripe with an organized nanofibrous structure formed from a nanofibrous plume and wound around the supporting linear formation into a helical form. After drying and fixing the stripe of nanofibers on the supporting linear formation, the resulting linear fibrous formation can be further processed by other conventional textile technologies, for example by knitting.

DESCRIPTION OF DRAWINGS

Other advantages and features of the method and device according to the invention are illustrated in the enclosed drawings, wherein.

DETAILED DESCRIPTION

Figure 1:
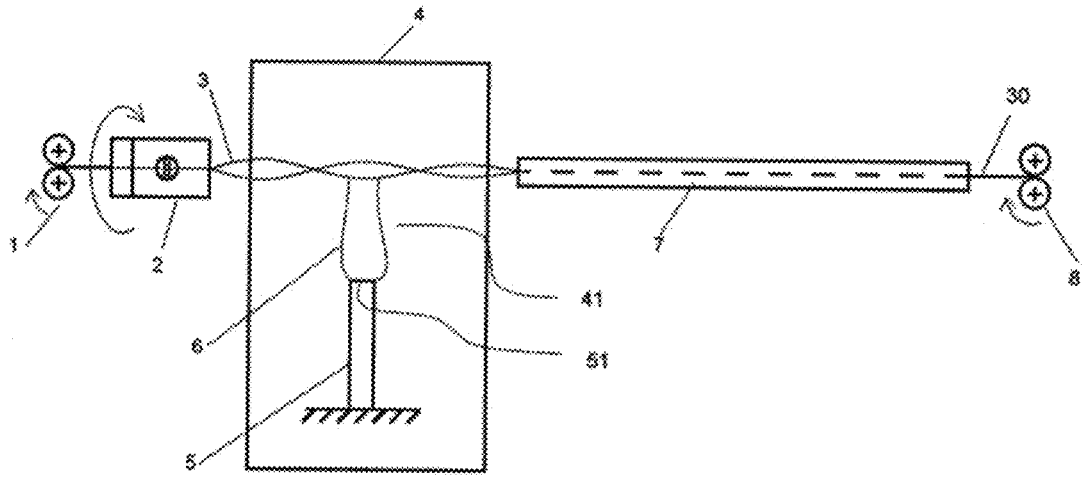
FIG. 1, FIG. 2 and FIG. 4 schematically represent examples of an embodiment for performing the method for the production of a linear fibrous formation according to the invention and the principle of this method.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the embodiment according to FIG. 1, in the direction of the movement of the supporting linear formation 3 are arranged behind one another a feeding device 1, which serves to unwind the supporting linear formation 3 in a known manner from an unillustrated supply package, a twisting device 2, which can form a balloon with at least one antinode loop or at least false twist on the supporting linear formation 3, and a spinning chamber 4. Behind the spinning chamber 4 is arranged a drying and fixing device 7 for drying and fixing a nanofibrous coating 32, preferably in the shape of a tube or a channel, and a draw-off mechanism 8, behind which the stabilized resulting linear fibrous formation 30 with a nanofibrous coating 32 according to the invention is wound on an unillustrated bobbin in a known manner. Optionally, the drawing-off of the resulting linear formation can be performed directly by a winding device.

Spinning takes place due to the effect of alternating current voltage according to CZ 304 137.

In the spinning chamber 4 is arranged a spinning electrode 5, which is connected to an unillustrated adjustable source of AC high voltage, for example having a voltage of 35 kV and a frequency of 50 Hz, and to an unillustrated inlet for supply of a polymeric solution for spinning. The polymeric solution is dispensed into the spinning chamber 4, for example by means of an unillustrated linear pump. In the vicinity of the front face 51 of the spinning electrode 5 and above it in the spinning chamber 4, there is spinning space 41. In case of need, the impact of electric winding is enhanced by airflow in a required direction. The nanofibrous plume 6 is electrically neutral, since during its movement through the spinning space 41, mutual recombination of opposite electric charges of the individual nanofibers or their segments occurs. The polymeric nanofibers in the nanofibrous plume 6 are arranged in an irregular grid structure, in which the individual nanofibers in short segments change their direction.

Figure 3:
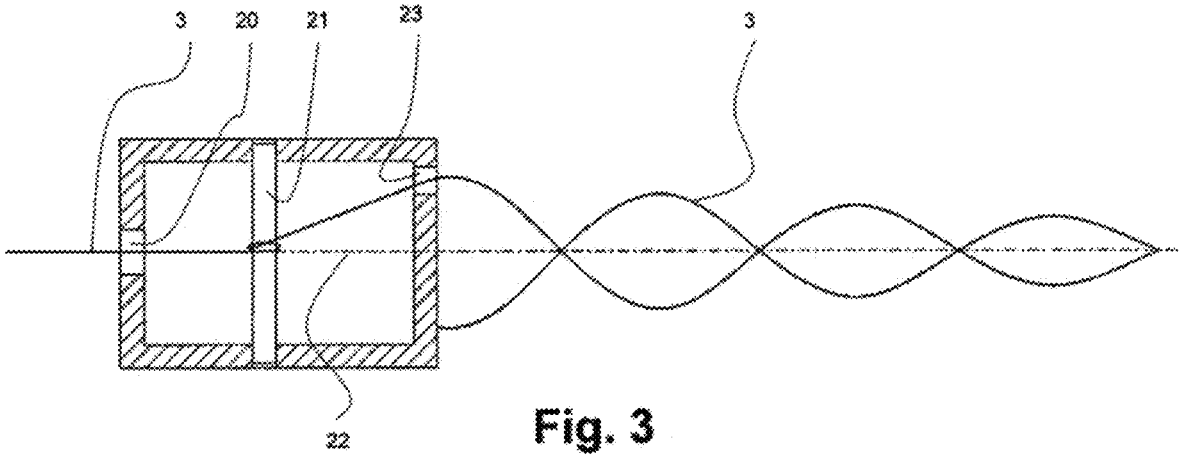
FIG. 3 shows the principle of ballooning or rotation of a supporting linear formation (silk, staple yarns, monofilament) by means of a twisting device with a twisting tube.
Figure 4:
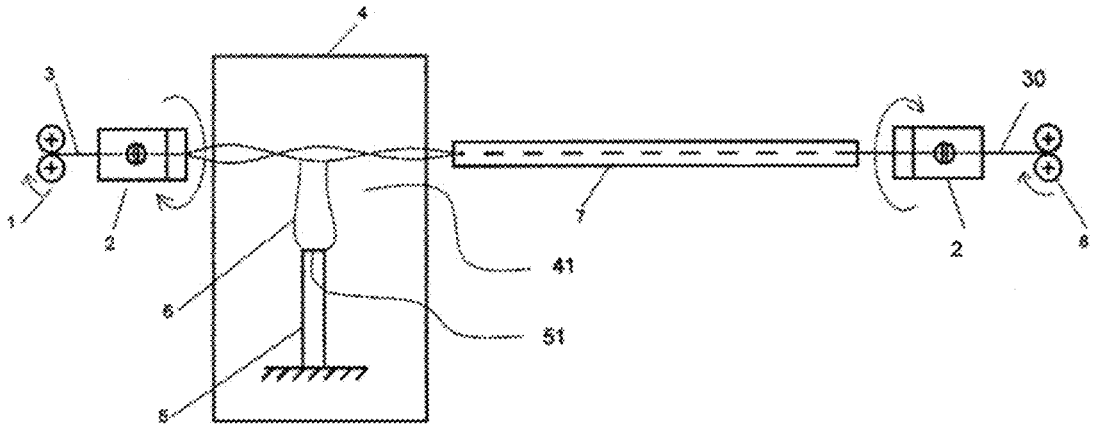
Figure 5:
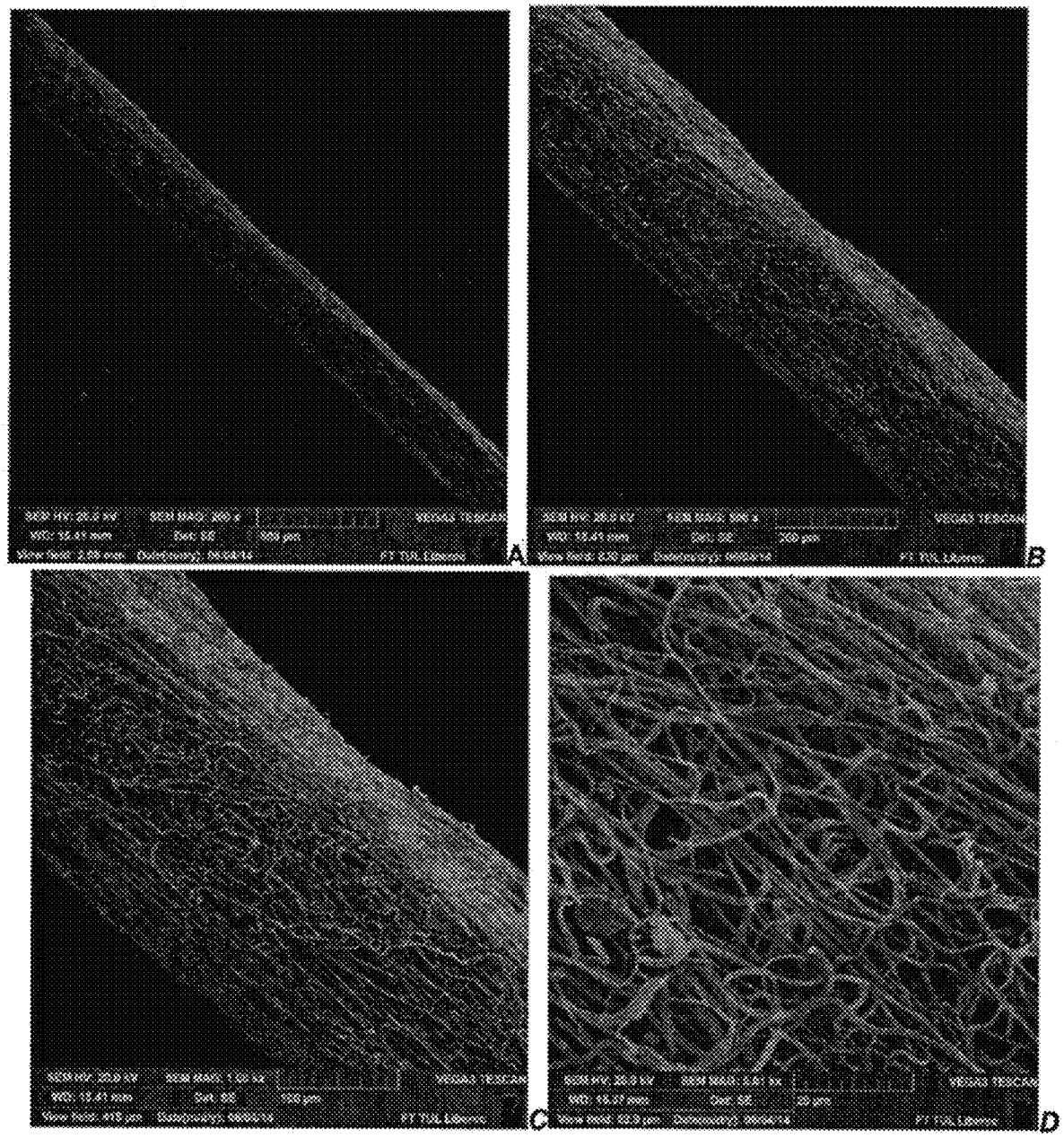
FIGS. 5*a*, 5*b*, 5*c* and 5*d* show the linear fibrous formation according to the invention at different magnifications of a scanning electron microscope (SEM)

As is shown in FIG. 3, the supporting linear formation 3, as a result of the rotation of the eccentric member 23 of the twisting device 2 through which it passes, for example the rotation of an opening located off the axis of the rotation of the twisting device 2, forms a balloon having several antinode loops passing through the spinning chamber 4, and in the spinning space 41, a nanofibrous plume 6 is deposited on the surface of the supporting linear formation 3 rotating in the balloon. The nanofibrous plume 6 is drifted to this space due to the effect of electric winding and wraps around the supporting linear formation 3, forming a stripe, that is, a flat formation created from the nanofibrous plume 6, which during ballooning winds around the core 31 (FIGS. 6-7) composed of a supporting linear formation 3, forming a nanofibrous coating 32 (FIGS. 6-7) on it, formed by helix-shaped windings. The antinode loops of the balloon are illustrated in FIGS. 1, 3 and 4, whereby FIG. 3 shows the twisting device and the antinodes of the supporting linear formation 3 constituting a core 31 of the resulting linear fibrous formation in the spinning chamber. The supporting linear formation 3 is fed from an unillustrated supply package by the feeding device 1 with a defined bias. The twisting device 2 is in the exemplary embodiment provided with an inlet 20, which is situated in its axis 22 of rotation. The supporting linear formation 3 is guided from the inlet 20 over a pin 21 to an eccentric member 23, which is in the illustrated embodiment formed by an axial orifice located off the axis 22 of the rotation of the twisting device 2. Due to the rotation of the twisting device 2 ballooning of the supporting linear formation 3 occurs, whereby onto the supporting linear formation 3 the nanofibrous plume 6 in the shape of a stripe is deposited in the spinning chamber 4.

If the winding speed of the nanofibrous plume 6 is the same as that of the process of its formation, the arrangement of nanofibers in the nanofibrous plume 6 remains the same even after it is wound around the core, as is apparent also on the coating 32 of the resulting linear fibrous formation 30, shown in FIGS. 5*a-d*. If the winding speed of the nanofibrous plume 6 is greater than the speed of its formation, the nanofibrous plume 6 becomes longer and, as a result, a certain orientation of the nanofibers in the structure of the nanofibrous plume 6 may occur after the nanofibrous plume 6 is wound onto the core 31.

From the spinning chamber 4, the produced resulting linear fibrous formation 30 with the nanofibrous coating 32 is withdrawn by the drawing-off mechanism 8 through the drying and fixing device 7, in which the nanofibrous coating 32 is dried and fixed at temperatures (for example, in the range from 60° C. to 250° C.) corresponding to the kind of the polymer being spun and the material of the supporting linear formation 3. The resulting linear fibrous formation 30 with the nanofibrous coating 32, usually called nanofibrous core yarn, is wound in a known manner onto an unillustrated bobbin behind the drawing-off mechanism 8.

In a series of verification experiments, AC high voltage of ±36 kV with a frequency of 50 Hz was supplied to the spinning electrode. Polyester multifilament having a fineness of 150 Tex was used as a core. The twisting device 2 rotated at a frequency of between 5,000 and 20,000 rpm, and the draw-off speed was set at 10 to 60 meters per minute. The material used for spinning was a solution of polyvinyl butyral (PVB) or polyacrylonitrile (PAN). Dispensing of the solution for the spinning electrode was set in the range of 80 to 250 ml per hour. The values of fiber diameters for the core yarn of PVB were in the range of 682±280 nm. During the spinning of the solutions of PAN, the mean value of the fiber diameter measured was 1805 nm with a large value of standard deviation of ±1322 nm and therefore with a significant proportion of nanofibers.

Figure 2:
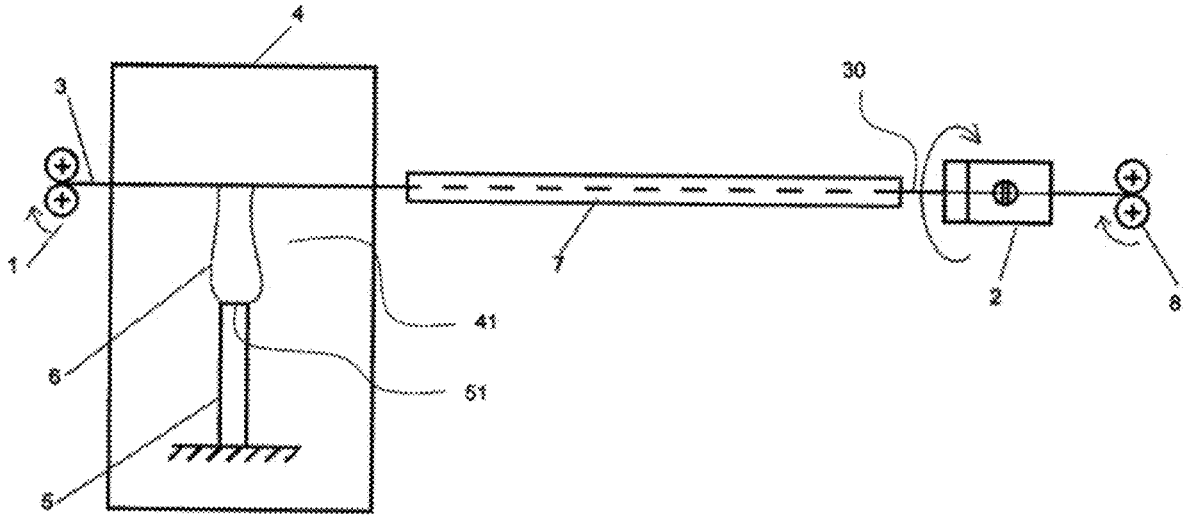

In the exemplary embodiment according to FIG. 2, the arrangement of the device is very similar to FIG. 1, only the twisting device 2 is disposed between the drying and fixing device 7 and the drawing-off device 8. In this arrangement, during the rotation of the twisting device 2, false twist is formed on the supporting linear formation 3 and on the resulting linear fibrous formation 31 between the twisting device 2 and the feeding device 1. Due to the location of the twisting device 2, ballooning does not occur in the spinning chamber 4 or its antinode loops are very small. Therefore, in the spinning chamber 4, the supporting fibrous formation 3 rotates around its axis and the nanofibrous plume 6, whose path is intersected by the supporting fibrous material 3, winds on it in the form of a stripe, which forms a layer in the form of a helix on the core 31. In this embodiment, ballooning can be achieved by blowing a pulsed airflow on the mechanically rotated supporting linear formation.

In the exemplary embodiment according to FIG. 4, two twisting devices 2 are used. The first twisting device is located in front of the spinning chamber 4, as in example 1, and ensures the ballooning of the supporting linear formation 3 in the spinning chamber 4 and the second twisting device 2 is located behind the drying and fixing device 7, as in example 2, and imparts false twist to the passing resulting linear fibrous formation 30, which is transmitted as far as to the supporting linear formation 3, constituting a core 31.

The revolutions of the second twisting device 2 implement false twist. It should be taken into account that real revolutions implementing false twist are lower than the revolutions of the second twisting device 2, since instead of pure rolling of the resulting linear fibrous formation 30 being twisted in cases when friction forces in the axial opening are exceeded, slippage and loss of twists occur. If the revolutions of the second twisting device 2 are greater than those of the first twisting device 2, during the winding of nanofibrous plume 6 onto the supporting linear formation 3 composed of a core 31, the nanofibrous stripe is twisted by the false twist, which leads to improving the strength of the connection of the nanofibrous coating 32 and the core 31 in the resulting linear fibrous formation 30, which has been experimentally verified. Having passed through the drying and fixing device 7 the nanofibrous coating is fixed on the core, apparently after the cancellation of the false twist behind the second twisting device 2.

If a nanofibrous coating 32 consisting of two or more layers of nanofibers is required, it appears to be advantageous to place two or more spinning electrodes 5 behind each other into the spinning chamber 4, so that from the spinning electrode 5, the first flat formation consisting of a hollow nanofibrous plume 6 is deposited on the supporting linear formation 3 during its ballooning and/or during the false-twisting operation, thereby creating the first nanofibrous layer. Subsequently, from the second spinning electrode 5, the second flat formation composed of a hollow nanofibrous plume 6 is deposited on the first layer of nanofibers in the same manner. Optionally, another flat formation consisting of a hollow nanofibrous plume 6 created by another spinning electrode 5 is deposited on the second layer of nanofibers. The individual layers of the nanofibrous coating can be composed of materials with different properties. For example, the first layer enveloping the supporting linear formation 3 constituting a core 31 of the resulting nanofibrous formation 30 is made of an adhesive material or a heat shrinkable material, such as PVB or polycaprolactone (PCL). In a preferred embodiment, the outer nanofibrous layer of the nanofibrous coating 32 is composed of a cover material capable of protecting the inner layers from damage, for example of polyvinylidene fluoride (PVDF) or polyurethane (PU).

A multi-layer nanofibrous coating 32 can be also produced by repeated applications of another layer to the preceding layer, whereby each layer is dried and fixed after being applied.

Figure 6:
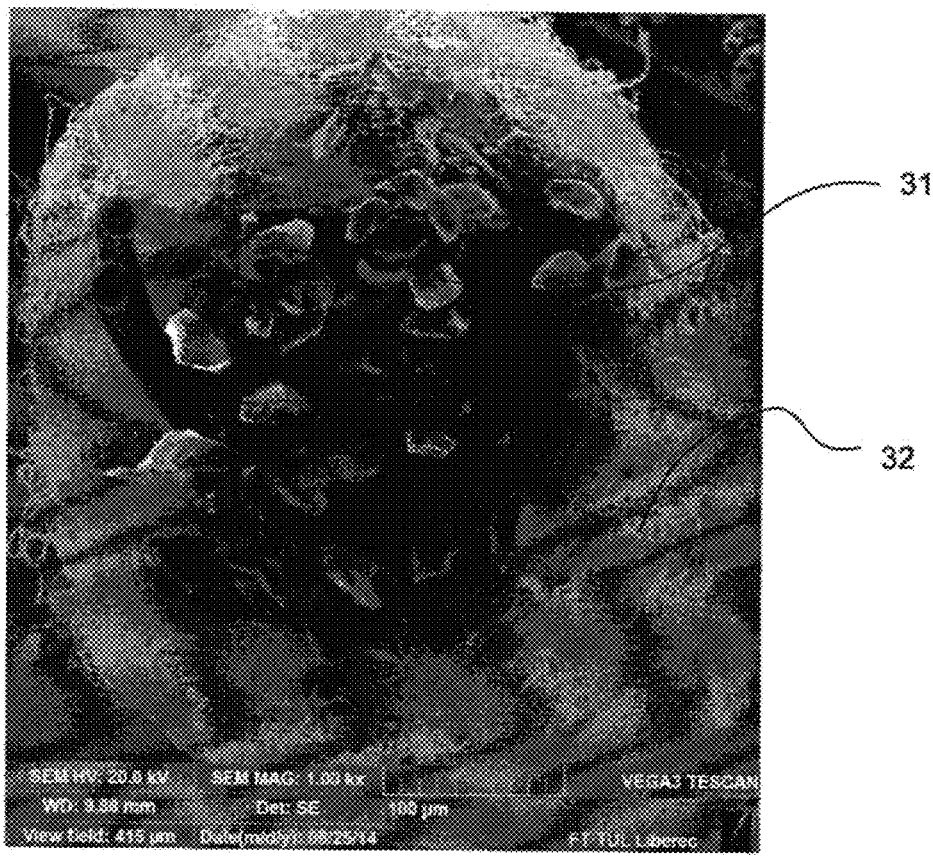
FIG. 6 is a SEM picture of a cross-section of the linear fibrous formation according to the invention with a coating of polymeric nanofibers and with a supporting linear formation formed by polyester yarn.
Figure 7:
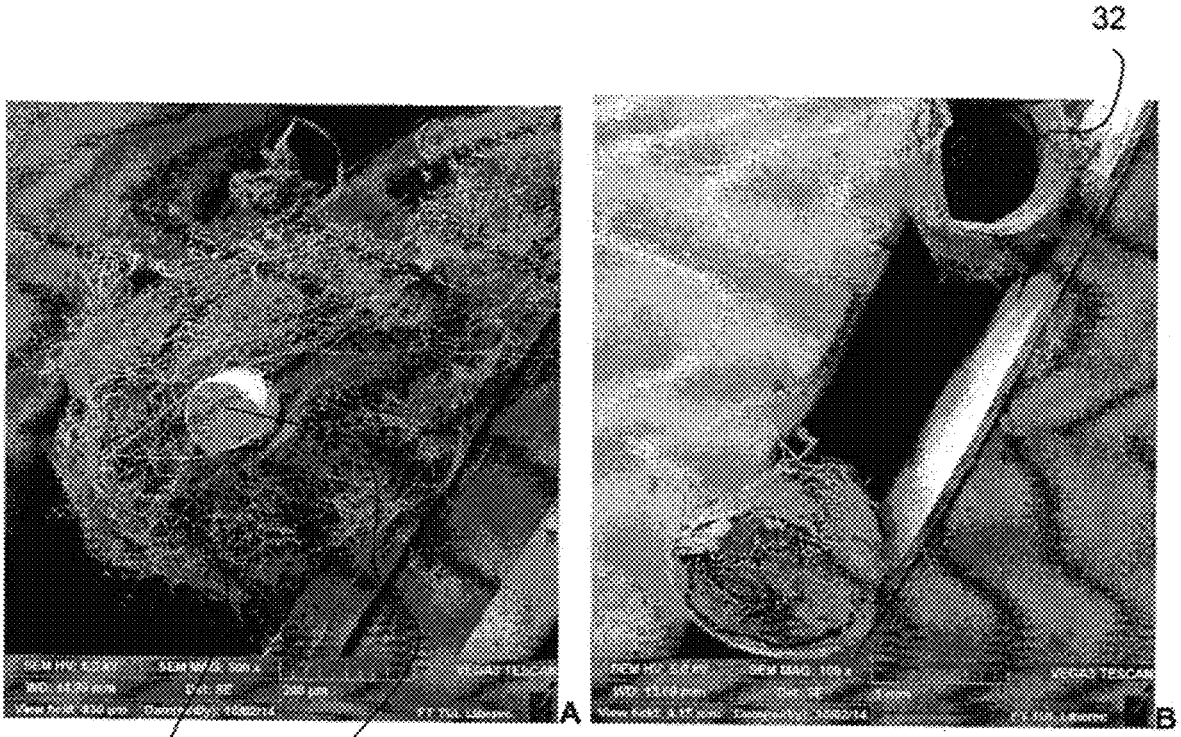
FIG. 7A shows a SEM image of a cross-section of the linear fibrous formation according to the invention with a supporting linear formation formed by monofilament.
FIG. 7B is a SEM image of a cross-section of a linear fibrous formation with a core composed of yarn and a coating of nanofibers and a cross-section of a nanofibrous tube formed after the removal of the core.
Figure 8:
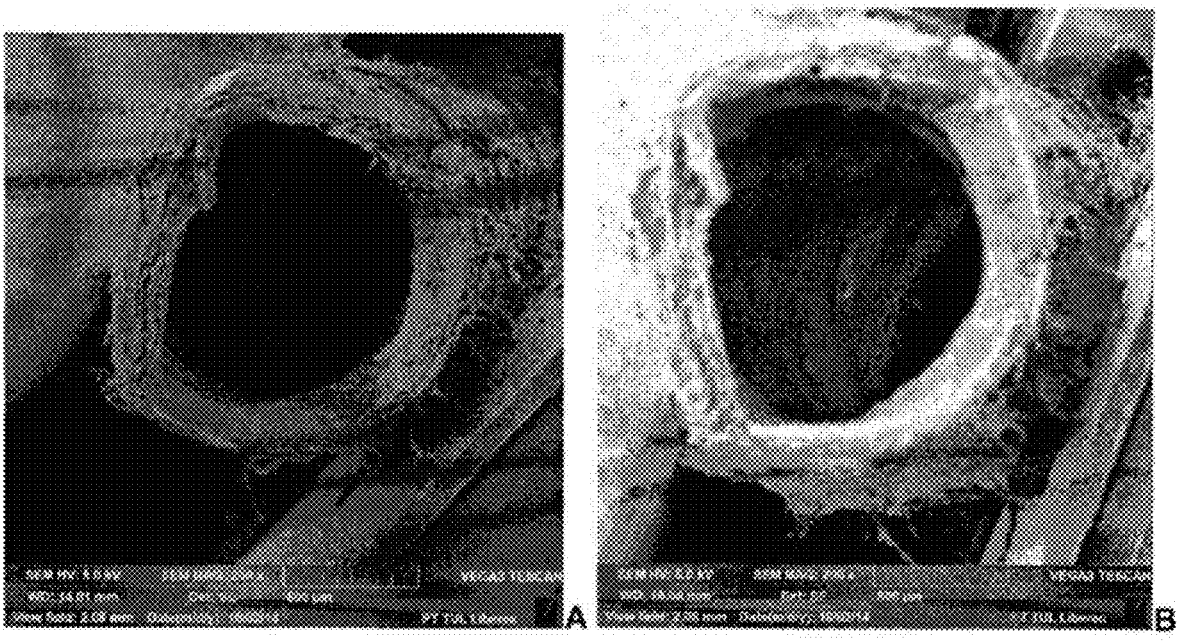
FIGS. 8A, B provide a detailed representation of a cross-section of a nanofibrous tube formed after the removal of the core.

By means of a strong or tight wind of the core yarn of a suitable thickness/fineness or monofilament having a suitable diameter, or a firm core of another material of a suitable shape and cross-section, the resulting linear formation 30 with a nanofibrous coating 32 is formed, as is shown in FIGS. 6 and 7. The supporting core is removed from the resulting linear formation 30 by pulling out, dissolving, washing out, or by using another appropriate method. The preserved nanofibrous coating 32, which covered the core 31, will create a tubular formation shown in FIGS. 7 and 8, which can serve, for example, as a nanofibrous synthetic blood vessel having a suitable diameter.

The formation of a tubular formation can be performed by a continuous or discontinuous method—according to requirements. Preferably, for the production of a tubular formation it is possible to use the device and the method according to FIG. 1 or 4.

INDUSTRIAL APPLICABILITY

Linear fibrous formations according to the invention can be processed as core yarn by subsequent textile technologies into flat or three-dimensional textile formations, or it is possible to remove a core from them and produce hollow nanofibrous tubular formations.

Modifications and variations can be made to the embodiments illustrated or described herein without departing from the scope and spirit of the invention as set forth in the appended claims.

LIST OF REFERENCES

1 feeding device
2 twisting device
20 inlet
21 pin
22 axis of rotation of twisting device
23 eccentric member
3 supporting linear formation
30 resulting linear fibrous formation with a nanofibrous coating
31 core of the resulting linear fibrous formation
32 nanofibrous coating
4 spinning chamber
41 spinning space
5 the spinning electrode
51 front face of spinning electrode
6 nanofibrous plume
7 a drying and fixing device
8 draw-off mechanism

The invention claimed is:

1. A system for production of a linear fibrous formation, the system comprising:

a spinning chamber;

a feeding device disposed so as to feed a supporting linear formation to the spinning chamber;

a spinning electrode arranged in the spinning chamber and connected to a source of AC electric voltage, wherein a hollow electrically neutral plume of polymeric nanofibers is formed in a spinning space above the spinning electrode in the spinning chamber such that in the spinning space in a vicinity of a front face of the spinning electrode and above it the plume is changed into a flat stripe having an organized structure of nanofibers, which is guided to the circumference of the supporting linear formation;

a draw-off device disposed to withdraw the linear fibrous formation from the spinning chamber;

a twisting device disposed in a path of the supporting linear formation, the twisting device configured to create a false twist in, or a rotating balloon from, the supporting linear formation in the spinning chamber; and wherein as a result of the false twist or ballooning of the supporting linear formation moving through the spinning chamber, the plume of polymeric nanofibers is wound around the supporting linear formation in a form of the flat stripe having the organized structure with the nanofibers forming a helix.

2. The system according to claim 1, further comprising a drying and fixing device downstream of the spinning chamber in the path of the supporting linear formation to dry and fix the stripe wound around the supporting linear formation in a helix.

3. The system according to claim 1, wherein the twisting device is arranged upstream of the spinning chamber.

4. The system according to claim 1, wherein the twisting device is arranged downstream of the drying and fixing device.

5. The system according to claim 1, wherein the twisting device comprises a rotating eccentric member.

6. The system according to claim 1, further comprising an additional spinning electrode arranged in the spinning chamber along the path of the supporting linear formation downstream of the spinning electrode.

* * * * *